US006119641A

United States Patent [19]

Koch et al.

[11] Patent Number: 6,119,641

[45] Date of Patent: Sep. 19, 2000

[54] APPARATUS AND METHOD FOR CONTROLLING A DEVICE FOR ADJUSTING A VALVE STROKE COURSE OF A GAS EXCHANGE VALVE OF AN INTERNAL COMBUSTION ENGINE

[75] Inventors: Achim Koch, Tegernheim; Bernhard Klingseis, Regensburg, both of Germany

[73] Assignee: Siemens Aktiengesellschaft, Munich, Germany

[21] Appl. No.: 09/309,961

[22] Filed: May 11, 1999

[30] Foreign Application Priority Data

May 12, 1998 [DE] Germany ..... 198 21 241

[51] Int. Cl.[7] ..... F01L 13/00

[52] U.S. Cl. ..... 123/90.17; 123/90.31; 123/198 D

[58] Field of Search ..... 123/90.15, 90.16, 123/90.17, 90.31, 198 D

[56] References Cited

U.S. PATENT DOCUMENTS

| | | | |
|---|---|---|---|
| 4,535,733 | 8/1985 | Honda | 123/90.17 |
| 5,052,350 | 10/1991 | King | 123/90.16 |
| 5,178,105 | 1/1993 | Norris | 123/90.15 |
| 5,431,132 | 7/1995 | Kreuter et al. | 123/90.16 |
| 5,555,860 | 9/1996 | Wride | 123/90.16 |
| 5,572,959 | 11/1996 | Hedelin | 123/48 C |
| 5,586,527 | 12/1996 | Kreuter | 123/90.15 |
| 5,592,906 | 1/1997 | Kreuter et al. | 123/90.16 |
| 5,832,886 | 11/1998 | Grob et al. | 123/90.17 |
| 5,931,127 | 8/1999 | Buck et al. | 123/90.17 |
| 6,032,625 | 3/2000 | Schwegler | 123/90.17 |

FOREIGN PATENT DOCUMENTS

| | | |
|---|---|---|
| 4244550A1 | 7/1994 | Germany . |
| 19650249A1 | 6/1998 | Germany . |

*Primary Examiner*—Weilun Lo
*Attorney, Agent, or Firm*—Herbert L. Lerner; Laurence A. Greenberg; Werner H. Stemer

[57] ABSTRACT

A device for adjusting a valve stroke course of a gas exchange valve includes a first camshaft which is coupled mechanically to a crankshaft, a second camshaft which is coupled mechanically to the first camshaft, an actuating drive which sets the phase of the second camshaft relative to the first camshaft and a transmission member which transmits the stroke of the camshafts to the gas exchange valve. An apparatus and a method for controlling the device have an actuating drive sensor which detects the angle of rotation of a drive shaft of the actuating drive. Furthermore, the apparatus has a determination unit which determines a quantity characterizing the valve stroke course as a function of the angle of rotation.

13 Claims, 3 Drawing Sheets

S1
START
S2
?
No
Yes
S3
?
No
Yes
S4
i=i+1
i=i-1
S5
S6
i=imax ?
No
Yes
S7
k=k+1
S8
i=0
S8a
i=-imax ?
No
Yes
S8b
k=k-1
S8c
i=0
S9
DRV=f(i,k)

APPARATUS AND METHOD FOR CONTROLLING A DEVICE FOR ADJUSTING A VALVE STROKE COURSE OF A GAS EXCHANGE VALVE OF AN INTERNAL COMBUSTION ENGINE

BACKGROUND OF THE INVENTION

FIELD OF THE INVENTION

The invention relates to an apparatus and a method for controlling a device for adjusting a valve stroke course of a gas exchange valve of an internal combustion engine, wherein the device includes a first camshaft coupled mechanically to a crankshaft; a second camshaft coupled mechanically to the first camshaft; an actuating drive setting a phase of the second camshaft relative to the first camshaft; and a transmission member transmitting the stroke of the cams of the camshafts to the gas exchange valve, in such a way that at least one quantity characterizing the valve stroke course is determined by the stroke course of the first camshaft and of the second camshaft.

German Published, Non-Prosecuted Patent Application DE 42 44 550 A1 discloses a device for adjusting a valve stroke course of a gas exchange valve of an internal combustion engine. That device is used preferably for a throttle free load control of gasoline engines. The device has two camshafts which rotate in opposition and act through a rocker arm on the gas exchange valve. One of the camshafts determines the opening function and the other camshaft the closing function of the gas exchange valve. The valve stroke course of the gas exchange valve, that is to say the stroke and the opening duration, can be varied within wide ranges by the rotation of the two camshafts relative to one another through the use of a four wheel coupling gear. The four wheel coupling gear has a driving wheel, which is firmly connected to the first camshaft driven by the crankshaft, and a driven wheel, which is firmly connected to the second camshaft. The driving and driven wheels are in engagement with one another through two intermediate wheels, in such a way that, as a result of rotational adjustment acting on the couplers, the intermediate wheels roll on the driving and driven wheels and rotation of the two camshafts relative to one another is thus achieved.

The safety requirements in internal combustion engines are continually becoming more stringent. This applies, in particular, to components which are provided for the load control of the internal combustion engine.

SUMMARY OF THE INVENTION

It is accordingly an object of the invention to provide an apparatus and a method for controlling a device for adjusting a valve stroke course of a gas exchange valve of an internal combustion engine, which overcome the hereinaforementioned disadvantages of the heretofore-known apparatuses and methods of this general type, which ensure that a quantity characterizing the valve stroke course is determined reliably, and which at the same time are simple and cost effective.

With the foregoing and other objects in view there is provided, in accordance with the invention, in an internal combustion engine including a crankshaft, a gas exchange valve having a valve stroke course and a device for adjusting the valve stroke course, the device including a first camshaft mechanically coupled to the crankshaft and having a cam with a stroke; a second camshaft mechanically coupled to the first camshaft and having a cam with a stroke; an actuating drive setting a phase of the second camshaft relative to the first camshaft, the actuating drive having a drive shaft with an angle of rotation; and a transmission member transmitting the stroke of the cams of the camshafts to the gas exchange valve, for determining at least one quantity characterizing the valve stroke course using the stroke courses of the first camshaft and of the second camshaft; an apparatus for controlling the device, comprising an actuating drive sensor detecting the angle of rotation of the drive shaft of the actuating drive; and a determination unit for determining a quantity characterizing the valve stroke course as a function of the angle of rotation of the drive shaft.

In accordance with another feature of the invention, there is provided a camshaft sensor for detecting an angle of rotation of the second camshaft, and a further determination unit for determining a quantity characterizing the valve stroke course as a function of the angle of rotation of the second camshaft.

With the objects of the invention in view, there is also provided a control method for the apparatus, which comprises monitoring the angle of rotation of the drive shaft as a function of the angle of rotation of the second camshaft and as a function of an angle of rotation of the crankshaft, and actuating emergency running when a faulty angle of rotation of the drive shaft is detected during monitoring.

In accordance with another mode of the invention, there is provided a control method which comprises determining a quantity characterizing the valve stroke course as a function of the angles of rotation of the second camshaft and of the crankshaft, in emergency running.

In accordance with a further mode of the invention, there is provided a control method which comprises determining a first value of a quantity characterizing the valve stroke course as a function of the angles of rotation of the second camshaft and of the crankshaft; determining a second value of the quantity characterizing the valve stroke course as a function of the angle of rotation of the drive shaft; and checking if the first value deviates by more than a predetermined threshold value from the second value, during monitoring.

In accordance with an added mode of the invention, there is provided a control method which comprises checking if the first value of the quantity characterizing the valve stroke course changes by more than a predetermined further threshold value within a predetermined time interval.

In accordance with an additional mode of the invention, there is provided a control method wherein the quantity characterizing the valve stroke course is a start of the valve stroke of the gas exchange valve or an end of the valve stroke of the gas exchange valve.

In accordance with yet another mode of the invention, there is provided a control method which comprises providing the actuating drive with a synchronous motor, and controlling current commutation of the synchronous motor as a function of the angle of rotation detected by the actuating drive sensor.

In accordance with yet a further mode of the invention, there is provided a control method which comprises calibrating the camshaft sensor as a function of the angle of rotation of the drive shaft of the actuating drive.

In accordance with yet an added mode of the invention, there is provided a control method which comprises detecting the angle of rotation of the crankshaft with a crankshaft sensor, and calibrating the crankshaft sensor as a function of the angle of rotation of the drive shaft of the actuating drive.

In accordance with yet an additional mode of the invention, there is provided a control method which comprises selecting an incremental encoder as the actuating drive sensor, and initializing the angle of rotation of the drive shaft as a function of the angles of rotation of the second camshaft and of the crankshaft, upon detecting a faulty angle of rotation of the drive shaft and/or satisfying a predetermined condition, during monitoring.

In accordance with a concomitant mode of the invention, there is provided a control method wherein the predetermined condition is that the internal combustion engine is started.

Other features which are considered as characteristic for the invention are set forth in the appended claims.

Although the invention is illustrated and described herein as embodied in an apparatus and a method for controlling a device for adjusting a valve stroke course of a gas exchange valve of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
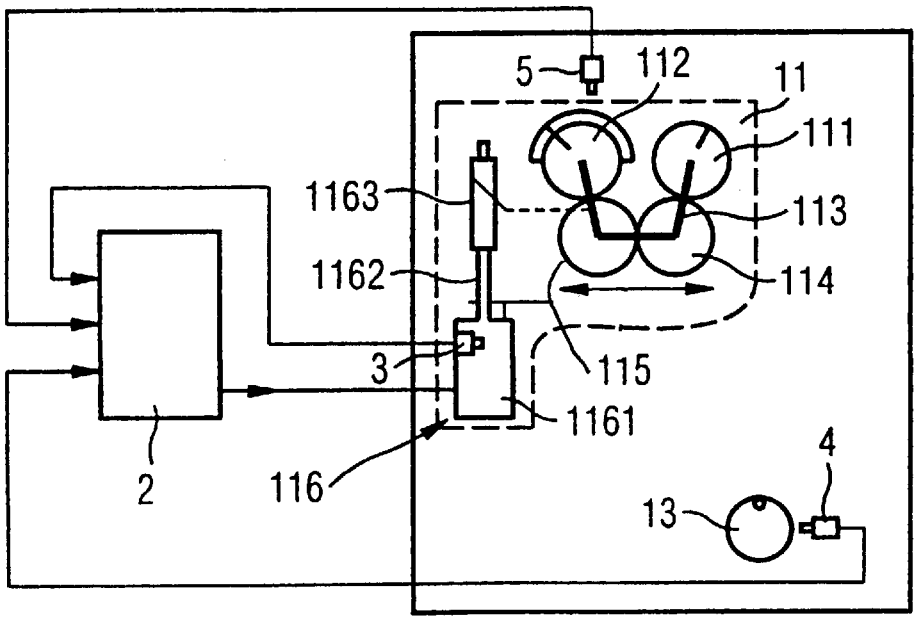
FIG. 1 is a diagrammatic, first elevational view of an internal combustion engine with a control apparatus according to the invention.
Figure 2:
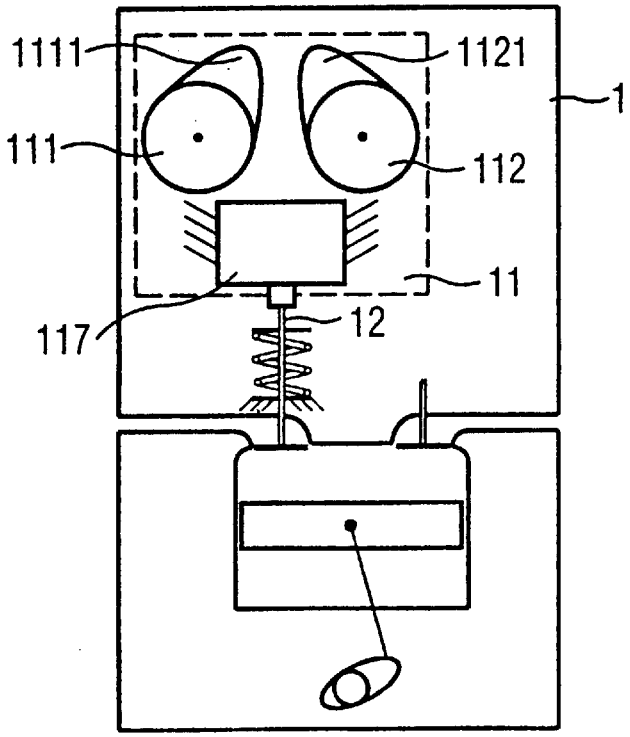
FIG. 2 is a second elevational view of the internal combustion engine.

Referring now in detail to the figures of the drawings, in which elements having an identical structure and function are given the same reference symbols, and first, particularly, to FIGS. 1 and 2 thereof, there is seen an internal combustion engine 1 that preferably has a device 11 in a cylinder head for adjusting a valve stroke of a gas exchange valve 12. The device 11 includes a first camshaft 111 which is coupled mechanically to a crankshaft 13, for example through a non-illustrated chain mechanism. A second camshaft 112 is coupled mechanically to the first camshaft 111 through a coupling gear which includes a coupler 113, a first gearwheel 114 and a second gearwheel 115. An actuating drive 116 is provided, having a motor 1161 that is preferably constructed as a simple synchronous motor with electronic commutation. The actuating drive 116 furthermore includes a drive shaft 1162 which is firmly connected through a worm wheel 1163 to a non-illustrated eccentric wheel that is disposed coaxially relative to the second camshaft 112 and is connected to the second camshaft 112. Rotation of the drive shaft 1162 is transmitted to the eccentric wheel through the worm wheel 1163. The rotation of the eccentric wheel causes a variation in the position of the second camshaft 112 relative to the first camshaft 111 in the direction illustrated by an arrow.

The first camshaft 111 and the second camshaft 112 each have a respective cam 1111 and 1121 seen in FIG. 2. The cams act on the gas exchange valve 12 through a transmission member 117 which may be constructed as a cup tappet, drag lever, rocker arm or other known transmission member.

A start of the valve stroke is predetermined by a stroke course of the first camshaft 111. An end of the valve stroke is predetermined by a stroke course of the second camshaft 112. The stroke course or profile of the first or second camshaft 111, 112 is determined by a contour of a section taken from the first or second camshaft 111, 112 perpendicularly to the axis of rotation of the camshaft. The stroke course is predetermined by a distance between points on the surface of the first camshaft 111 or the second camshaft 112 and the respective axis of rotation.

Adjustment of the position of the second camshaft 112 relative to the first camshaft 111 results in adjustment of the phase of the second camshaft 112 relative to the first camshaft 111. The phase is determined by an angle between two vectors. One vector lies perpendicularly to the axis of rotation of the first camshaft and has a base point which is the axis of rotation of the first camshaft and an endpoint that is a predetermined point on the circumference of the first camshaft. The other vector lies perpendicularly to the axis of rotation of the second camshaft and has a base point which is located in the axis of rotation of the second camshaft 112 and an endpoint that is a predetermined point on the circumference of the second camshaft. In order to determine the phase, one of the vectors is displaced in parallel, in such a way that its base point coincides with the base point of the other vector.

The transmission member 117 is constructed in such a way that it transmits the stroke course of the first camshaft 111 and second camshaft 112 to the gas exchange valve 12 only when both cams 1111, 1121 act simultaneously on the transmission member 117. The end of the valve stroke can be varied by adjusting the phase of the second camshaft 112 relative to the first camshaft 111. In an alternative embodiment, the phase is adjusted in such a way that the start of the valve stroke is variable.

The device 11 is associated with a control apparatus 2 shown in FIG. 1, which determines a control signal for the synchronous motor 1161 as a function of an angle of rotation DRV of the drive shaft 1162, of an angle of rotation CRK of the crankshaft 13, of an angle of rotation CAM of the second camshaft 112, and preferably as a function of further operating quantities of the internal combustion engine. The angle of rotation DRV is detected by an actuating drive sensor 3, the angle of rotation CRK is detected by a crankshaft sensor 4 and the angle of rotation CAM is detected by a camshaft sensor 5. Moreover, the control apparatus also runs through functions for monitoring the actuating drive sensor 3, the crankshaft sensor 4 and the camshaft sensor 5. The control apparatus 2 is also preferably constructed for controlling non-illustrated injection valves and a throttle valve of the internal combustion engine.

The actuating drive 116 can be constructed in a particularly space saving way if, in addition, a signal for commutating the current through the armature winding of the synchronous motor 1161 is generated from the angle of rotation DRV detected by the actuating drive sensor 3. The actuating drive sensor 3 can then be disposed directly in the synchronous motor 1161.

Figure 3:
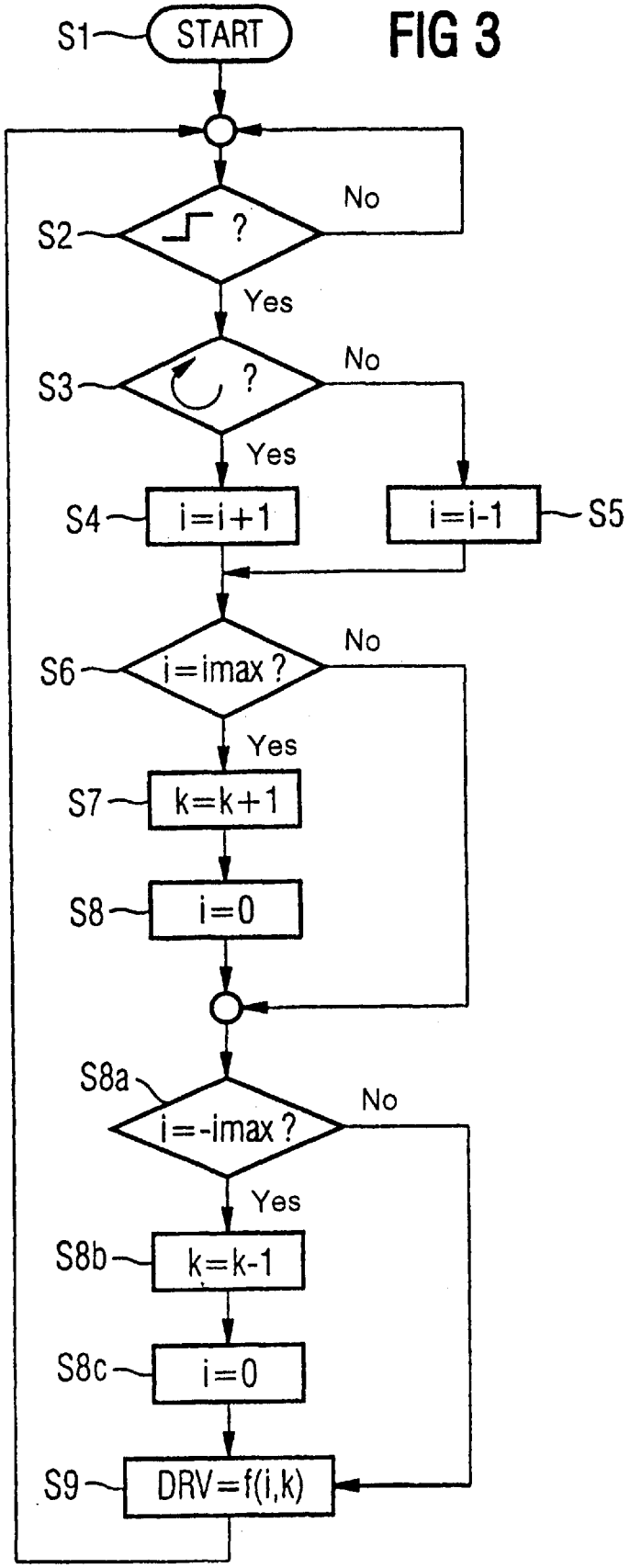
FIG. 3 is a flow diagram of a first part of a program which is run through in the control apparatus.

FIG. 3 shows a flow diagram of a function for determining the angle of rotation DRV of the drive shaft 1162, in which the control apparatus 2 runs through the flow diagram. The actuating drive sensor 3 includes a magnetic wheel which is disposed on the drive shaft and has a predetermined number of pairs of poles (for example 32) and a predetermined number of Hall elements (for example 2) that are disposed, phase shifted, in a housing of the electric motor 1161.

A start of the program takes place in a step S1, and values of counters i, k are read in from a data memory. A check is performed in a step S2 as to whether or not a measurement signal of a first Hall element of the actuating drive sensor 3 has an edge. If it does not, processing is continued in the step S2 after a predetermined waiting time. If it does, however, the direction of rotation of the drive shaft 1162 is determined in a step S3, by an evaluation of the measurement signals of the first and second Hall elements. If the direction of rotation of the drive shaft 1162 is a predetermined direction of rotation, the counter i is incremented in a step S4. However, if it is not, the counter i is decremented in a step S5.

A check is performed in a step S6 as to whether or not the counter i has a maximum value imax corresponding to the number of pairs of poles of the magnetic wheel (for example 32). If it does, the counter k is incremented in a step S7. The counter k is a measure of the number of revolutions of the drive shaft 1162 in relation to a reference angle. Depending on the structure of the device 11, this reference angle may be the angle of rotation of the drive shaft 1162, at which the phase of the second camshaft 112 relative to the first camshaft has a minimum or maximum value. The counter i is reset in a step S8, for example by giving it the value zero. A check is performed in a step S8*a* as to whether or not the counter i has a negative maximum value −imax. If it does, the counter k is decremented in a step S8*b* and the counter i is reset in a step S8*c*.

The angle of rotation DRV of the drive shaft 1162 is determined in a step S9 as a function of the counters i and k. The value of the counter k corresponds to the number of revolutions of the drive shaft 1162 in relation to the reference point and the counter k corresponds to the angle during a rotation of the drive shaft, with a resolution which depends on the number of pairs of poles. Moreover, the variables k and i are stored in the data memory in the step S9. The steps S1 to S9 are preferably carried out in the form of an interrupt routine.

Figure 4:
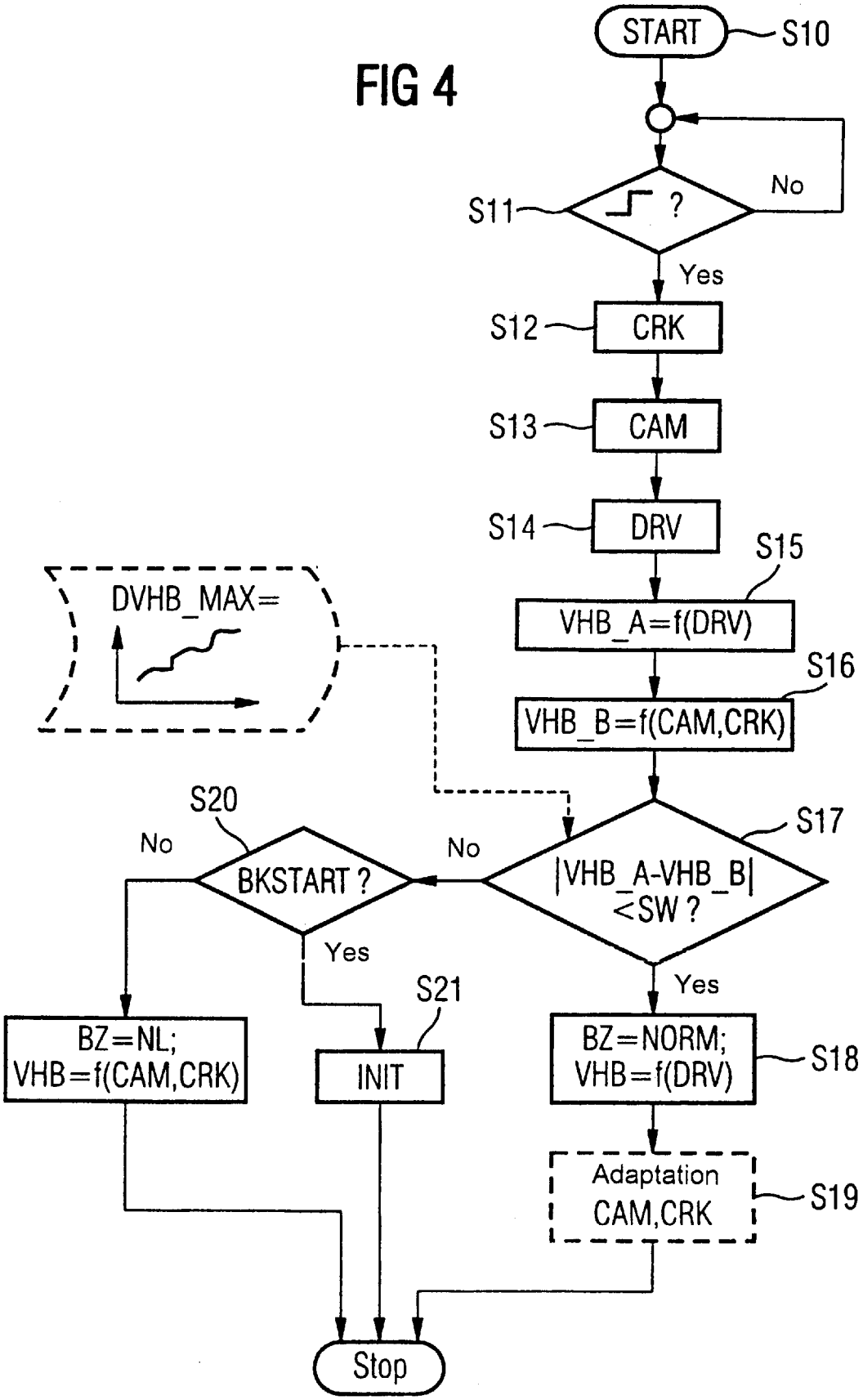
FIG. 4 is a flow diagram of a second part of the program which is run through in the control apparatus.

A start of a second program part, which is run through in the control apparatus 2, takes place in a step S10 shown in FIG. 4. A check is performed in a step S11 as to whether or not the measurement signal of the camshaft sensor 5 has an edge. The camshaft sensor 5 is preferably constructed as a simple Hall sensor with a two pole magnetic wheel which is disposed on the second camshaft 112. The measurement signal of the camshaft sensor 5 therefore supplies two signal edges for each revolution of the second camshaft 112.

If it is determined in the step S11 that the measurement signal of the camshaft sensor 5 does not have an edge, processing is continued again in the step S1 after a predetermined waiting time. Otherwise, current angles of rotation CRK, CAM, DRV of the crankshaft 13, of the second camshaft 112 and of the drive shaft 1162 are read-in in steps S12 to S14.

A first value VHB_A of the start of the valve stroke of the gas exchange valve 12 is determined in a step S15 as a function of the angle of rotation DRV of the drive shaft 1162. The first value VHB_A is preferably determined from a first characteristic curve as a function of the angle of rotation DRV of the drive shaft 1162. A second value VHB_B of the start of the valve stroke is determined in a step S16 as a function of the angle of rotation CAM of the second camshaft and of the angle of rotation CRK of the crankshaft 13. More specifically, it is preferably determined from a first characteristic map as a function of the angles of rotation CAM, CRK.

A check is performed in a step S17 as to whether or not the first value VHB_A deviates from the second value VHB_B by less than a predetermined threshold value SW. If it does, fault-free operation of the actuating drive sensor 3 is deduced and, in a step S18, a normal operating state BZ=NORM is assumed. In the normal operating state BZ=NORM, the start of a valve stroke VHB is determined as a function of the angle of rotation DRV of the drive shaft 1162. Again specifically, this is preferably determined from the first characteristic curve.

The start of the valve stroke VHB is a quantity characterizing the valve stroke course of the gas exchange valve 12. Further quantities characterizing the valve stroke course are, for example, the end of the valve stroke, if the end of the valve stroke can be adjusted variably, or an opening area integrated over the entire opening duration of the gas exchange valve 12 during one work cycle of the internal combustion engine.

Adaptation of the angle of rotation CAM detected by the camshaft sensor 5, and of the angle of rotation CRK detected by the crankshaft sensor 4, can be carried out at predetermined time intervals in a step S19, which is illustrated by broken lines. For this purpose, the angle of rotation DRV of the actuating drive shaft 1162 is converted into a desired value of the angle of rotation CAM of the second camshaft 112, taking into account the transmission ratio of the worm-wheel gear and the current angle of rotation CRK of the crankshaft 13. A correction value is then determined from the desired value and from the angle of rotation DRV of the second camshaft 112 determined by the camshaft sensor 5. The angle of rotation CAM detected by the camshaft sensor 5 is corrected through the use of the correction value. Alternatively, in the step S19, a desired value of the angle of rotation of the crankshaft 13 may also be determined as a function of the angle of rotation DRV of the drive shaft 1162 and of the angle of rotation CAM of the second camshaft 112. A correction value is determined as a function of the desired value and of the angle of rotation CRK of the crankshaft 13 detected by the crankshaft sensor 4. The angle of rotation CRK of the crankshaft is corrected through the use of the correction value. Thus, inaccuracies in the installation of the camshaft sensor 5 or of the crankshaft sensor 4 and manufacturing inaccuracies in the crankshaft sensor 4 and the camshaft sensor 5 can be compensated in a simple way.

If the first value VHB_A of the start of the valve stroke deviates from the second value VHB_B of the start of the valve stroke in the step S17 by more than the predetermined threshold value SW, a check is performed in a step S20 as to whether or not the internal combustion engine is in a starting state BKSTART. If it is, the value of the counter k is determined as a function of the angle of rotation CRK of the crankshaft 13 and of the angle of rotation CAM of the second camshaft 112 in a step S21. The counter is then set to this value, that is to say it is initialized, as is indicated by a symbol INIT. It is thus possible, in a simple way, to avoid having to run the drive shaft 1162 of the actuating drive 116 to the predetermined reference point after the internal combustion engine has been started. This is an advantage, in particular, when the stored values of the variables i and k are lost due to a voltage loss or a "reset" of the control apparatus 2. This ensures that a motor vehicle, in which the control apparatus 2 is disposed, has a high degree of driving comfort.

If the condition of step S20 is not satisfied, an emergency running operating state BZ=NL is assumed. The start of the valve stroke VHB is then determined as a function of the angles of rotation CAM, CRK of the second camshaft 112 and of the crankshaft 13. More specifically, this is preferably done from the first characteristic map. In emergency running NL, the load control of the internal combustion engine then takes place through a load actuator which, for example, is a throttle valve. The actuating drive 16 is then no longer controlled by the control apparatus 2, since the angle of rotation DRV of the drive shaft is no longer detected in a fault-free manner by the actuating drive sensor 3 and, consequently, correctly timed commutation of the armature current is no longer ensured. A quantity characterizing the valve stroke course of the gas exchange valve is then determined from the start of the valve stroke VHB. That quantity is then taken into account as a correction value in the determination of a control signal for the load actuator.

This then ensures comfortable emergency running, in which the wish of a driver of the motor vehicle having the control apparatus 2 can be converted accurately into a corresponding output torque of the internal combustion engine.

The invention is not restricted to the exemplary embodiment described herein. Thus, instead of the start of the valve stroke VHB, another quantity characterizing the valve stroke course of the gas exchange valve 12 can be determined. The steps S15 to S22 are then run through on the basis of this quantity.

It is preferably ensured, during the monitoring of the angle of rotation DRV of the drive shaft 1162, that the angles of rotation CAM, CRK of the second camshaft 112 and of the crankshaft 13 are detected in a fault-free manner.

If appropriate, an existing crankshaft sensor may also be monitored, together with the camshaft sensor. It is therefore merely necessary to provide precisely one camshaft sensor for both camshafts.

Characteristic curves or characteristic maps are determined by tests on an engine test bench or by driving tests.

We claim:

1. In an internal combustion engine including a crankshaft, a gas exchange valve having a valve stroke course and a device for adjusting the valve stroke course, the device including:

a first camshaft mechanically coupled to the crankshaft and having a cam with a stroke;

a second camshaft mechanically coupled to the first camshaft and having a cam with a stroke;

an actuating drive setting a phase of the second camshaft relative to the first camshaft, the actuating drive having a drive shaft with an angle of rotation; and a transmission member transmitting the stroke of the cams of the camshafts to the gas exchange valve, in such a way that at least one quantity characterizing the valve stroke course is given by the stroke courses of the first camshaft and of the second camshaft;

an apparatus for controlling the device, comprising:

an actuating drive sensor detecting the angle of rotation of the drive shaft of the actuating drive; and a determination unit for determining a quantity characterizing the valve stroke course as a function of the angle of rotation of the drive shaft.

2. The apparatus according to claim 1, including a camshaft sensor for detecting an angle of rotation of the second camshaft, and a further determination unit for determining a quantity characterizing the valve stroke course as a function of the angle of rotation of the second camshaft.

3. A control method for an apparatus according to claim 2, which comprises:

monitoring the angle of rotation of the drive shaft as a function of the angle of rotation of the second camshaft and as a function of an angle of rotation of the crankshaft, and actuating emergency running when a faulty angle of rotation of the drive shaft is detected during monitoring.

4. The control method according to claim 3, which comprises determining a quantity characterizing the valve stroke course as a function of the angles of rotation of the second camshaft and of the crankshaft, in emergency running.

5. The control method according to claim 3, which comprises:

determining a first value of a quantity characterizing the valve stroke course as a function of the angles of rotation of the second camshaft and of the crankshaft;

determining a second value of the quantity characterizing the valve stroke course as a function of the angle of rotation of the drive shaft; and checking if the first value deviates by more than a predetermined threshold value from the second value, during monitoring.

6. The control method according to claim 5, which comprises checking if the first value of the quantity characterizing the valve stroke course changes by more than a predetermined further threshold value within a predetermined time interval.

7. The control method according to claim 5, wherein the quantity characterizing the valve stroke course is a start of the valve stroke of the gas exchange valve.

8. The control method according to claim 5, wherein the quantity characterizing the valve stroke course is an end of the valve stroke of the gas exchange valve.

9. The control method according to claim 3, which comprises providing the actuating drive with a synchronous motor, and controlling current commutation of the synchronous motor as a function of the angle of rotation detected by the actuating drive sensor.

10. The control method according to claim 3, which comprises calibrating the camshaft sensor as a function of the angle of rotation of the drive shaft of the actuating drive.

11. The control method according to claim 3, which comprises detecting the angle of rotation of the crankshaft with a crankshaft sensor, and calibrating the crankshaft sensor as a function of the angle of rotation of the drive shaft of the actuating drive.

12. The control method according to claim 3, which comprises selecting an incremental encoder as the actuating drive sensor, and initializing the angle of rotation of the drive shaft as a function of the angles of rotation of the second camshaft and of the crankshaft, upon at least one of detecting a faulty angle of rotation of the drive shaft and satisfying a predetermined condition, during monitoring.

13. The control method according to claim 12, wherein the predetermined condition is that the internal combustion engine is started.

* * * * *